US006259208B1

(12) United States Patent
Crouch

(10) Patent No.: US 6,259,208 B1
(45) Date of Patent: Jul. 10, 2001

(54) OPTICAL TUNING OF MAGNETRON USING LEAKY LIGHT STRUCTURE

(76) Inventor: David D. Crouch, 1278 Biltmore Cir., Corona, CA (US) 91720

( * ) Notice: Subject to any disclaimer, the term of this patent is extended or adjusted under 35 U.S.C. 154(b) by 0 days.

(21) Appl. No.: 08/818,858

(22) Filed: Mar. 17, 1997

(51) Int. Cl.[7] ..... H01J 23/36

(52) U.S. Cl. ..... 315/39.55; 315/39.57; 315/39.59; 315/5.53; 315/5.46; 333/235; 331/90

(58) Field of Search ..... 315/39.55, 39.57, 315/39.59, 5.53, 5.46; 333/235; 331/90

(56) References Cited

U.S. PATENT DOCUMENTS 4,282,499 * 8/1981 De Fonzo ..... 333/235 X
5,099,214 * 3/1992 Rosen et al. ..... 333/258 X

FOREIGN PATENT DOCUMENTS

2020088 * 11/1992 (WO) ..... 315/39.55

* cited by examiner

*Primary Examiner*—Benny T. Lee
(74) *Attorney, Agent, or Firm*—David W. Collins; Glenn H. Lenzen, Jr.

(57) ABSTRACT

An optically tuned magnetron oscillator employs materials whose electrodynamic properties are altered by the absorption of light. A probe constructed from a leaky dielectric light guide coated with a photoconductive material is inserted into each of the magnetron's cavities. When light is injected into the light guide, it leaks into the coating where it is absorbed, creating free charge carriers whose presence alters the dielectric properties of the material, thereby perturbing the resonant frequency of the cavity. The frequency can be controlled by varying the amount of light injected into each of the optical probes. When no light is present, the resonant frequency of the magnetron cavity will be at one extreme of its operating band; when the light is at full intensity, the change in the properties of the probe will be maximum as will be the change in the resonant frequency.

19 Claims, 3 Drawing Sheets

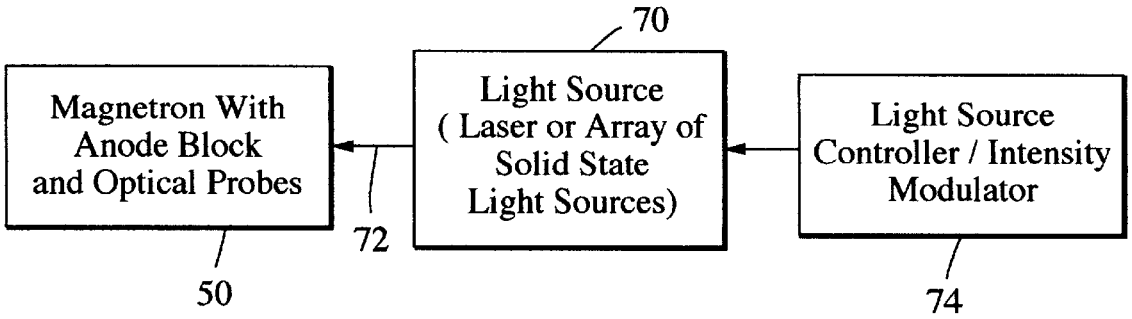
FIG. 4
FIG. 5
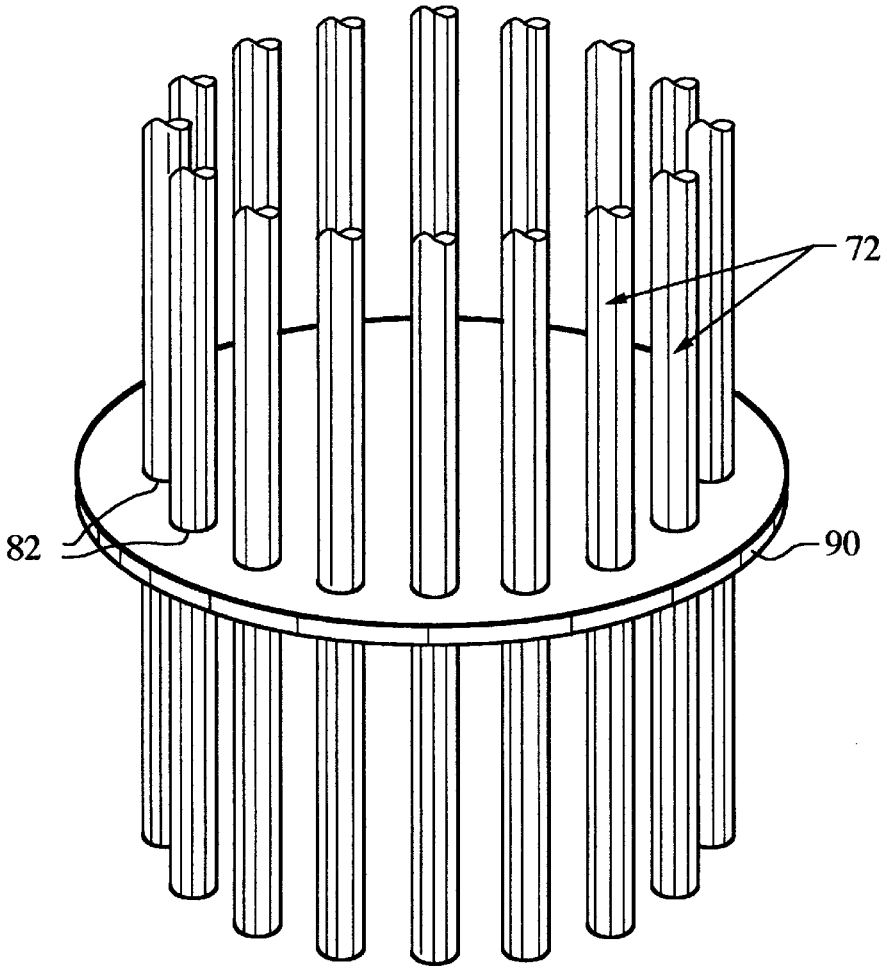

OPTICAL TUNING OF MAGNETRON USING LEAKY LIGHT STRUCTURE

TECHNICAL FIELD OF THE INVENTION

This invention relates to magnetron oscillators, and more particularly to optical techniques by which a magnetron oscillator can be frequency tuned.

BACKGROUND OF THE INVENTION

Mechanically tuned magnetrons are widely available, but they suffer from two distinct disadvantages. This type of magnetron can provide only slow frequency tuning, and requires that moving parts penetrate the vacuum envelope of the magnetron, which has an impact on the reliability of the device.

Mechanically tuned magnetron oscillators are typically one of two types, the plunger-tuned magnetron and the coaxial magnetron. The plunger-tuned magnetron uses a plunger to which metallic probes are attached, and inserts and retracts probes from each of the magnetron's resonant cavities in order to perturb their resonant frequencies. FIG. 1 illustrates an exemplary plunger-tuned magnetron, using a "crown-of-thorns" tuning scheme, in cross-section. The anode block encircles the cathode, and a number of resonant cavities are formed in the end spaces between the anode block and the cathode. The inductive tuning elements, supported on a tuner frame, are inserted into and retracted from the resonant cavities on bellows, in order to change the cavities' inductance and hence their resonant frequencies.

The coaxial magnetron places the magnetron anode block inside a coaxial resonant cavity, whose dimensions are mechanically changed to tune the frequency.

Both types of magnetrons suffer from all the disadvantages inherent in mechanically tuned mechanisms, i.e., they are slow and require that moving parts penetrate the vacuum envelope.

It would therefore represent an advance in the art to provide an electronic tuning mechanism for a magnetron oscillator so that the frequency can be varied more rapidly than is possible with mechanical tuning.

It would further be advantageous to provide a magnetron oscillator wherein device construction is simplified with no moving parts penetrating the vacuum envelope, thereby lowering the fabrication cost and providing increased reliability.

SUMMARY OF THE INVENTION

These and other advantages and advances are provided by an optically tuned magnetron oscillator. The magnetron employs materials whose electrodynamic properties are altered by the absorption of light. A probe constructed from a leaky dielectric light guide coated with a photoconductive material is inserted into each of the magnetron's cavities. When light is injected into the light guide, it leaks into the coating where it is absorbed as it creates free charge carriers, whose presence alters the reflective characteristics of the coating, thereby perturbing the resonant frequency of the cavity. The frequency can be controlled by varying the amount of light injected into each of the optical probes. When no light is present, the resonant frequency of the magnetron cavity will be at one extreme of its operating band; when the light is at full intensity, the change in the properties of the probe will be maximum as will be the change in the resonant frequency. The invention provides an electronic means of tuning a magnetron, whereas existing tunable magnetrons are tuned by mechanical structures.

BRIEF DESCRIPTION OF THE DRAWING

These and other features and advantages of the present invention will become more apparent from the following detailed description of an exemplary embodiment thereof, as illustrated in the accompanying drawings, in which:

FIG. 4 is a schematic block diagram of an optically tuned magnetron oscillator in accordance with the invention.

FIG. 5 illustrates a feedthrough plate for passing optical fibers through the magnetron structure to feed the optical probes.

DETAILED DESCRIPTION OF THE PREFERRED EMBODIMENT

Figure 2:
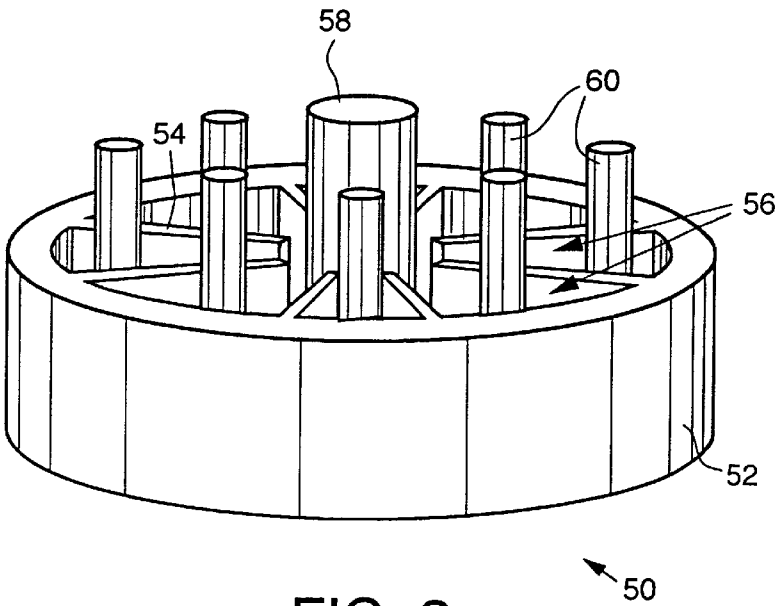
FIG. 2 is an isometric view of a magnetron anode structure with optical tuning elements in accordance with the invention.

An optically tuned magnetron oscillator 50 is illustrated in pertinent part in FIG. 2, and includes a cathode 58, and a magnetron anode block 52 with a plurality of radial vanes 54, all fabricated of electrically conductive material. The vanes and anode block define a plurality of resonant cavities 56. To the extent just described, the elements of the magnetron oscillator are conventional.

The magnetron 50 is tuned optically using optical tuning elements or probes 60 that extend into each resonant cavity 56 in the magnetron's anode block 52, as illustrated in FIG. 2. Each probe 60 is a leaky dielectric light guide to which a photoconductive coating or cover has been applied. As light propagates through the leaky guide, it leaks into the photoconductive coating. The wavelength of the light and the coating material are chosen so that the light is strongly absorbed by the coating material through the creation of electron-hole pairs. The presence of the free carriers strongly alters the electrodynamic properties of the coating, causing the material to strongly reflect incident microwave radiation, with the degree of reflection depending on the incident light intensity. As a result, the resonant frequency of each of the cavities will change, and with it the frequency of the magnetron's microwave output.

The probes 60 can take several forms. In one embodiment illustrated in FIG. 3A, the probes 60 are constructed using a dielectric, non-photoconducting rod 62 as the core, with a photoconducting outer jacket 64. The dielectric core can be of the same material conventionally used to construct optical fiber, i.e. silica. The photoconducting material can be single-crystal silicon or germanium, for example. In order for carriers to be excited from the valence band into the conduction band, the energies of individual photons of the incident light must exceed the bandgap energy of the semiconductor. Therefore, the wavelength of the light must be shorter than that at which the photon energy is just equal to the bandgap energy. The bandgaps for silicon and germanium are 1.08 eV and 0.66 eV, respectively. The corresponding wavelengths are 1.15 micron and 1.88 micron, respectively. Light of wavelength shorter than the bandgap wavelength will be absorbed more strongly and over a shorter distance (up to some limit) as the wavelength is decreased.

The probe 60 can be constructed by drilling a hole of diameter equal to that of the dielectric core in a solid cylindrical rod of silicon, for example, the outer radius of the rod being equal to the outer radius of the finished probe. By heating the annular photoconducting jacket, the dielectric core can be inserted into the jacket. Upon cooling, the jacket will contract, holding the core in place. By annealing this assembly, an even tighter bond can be formed between the core and the jacket. Light is injected into the rod 62 at exposed end surface 62A (FIG. 3A). Preferably, the opposite end surface 62B is covered with the photoconducting material as well. This can be accomplished by drilling the hole so as not to penetrate the end surface of the silicon rod, so that the opposing end of the rod is not exposed.

The dimensions of the probes will of course depend on the frequency at which the magnetron operates, and the desired tuning range. For a magnetron having a center frequency of 1 GHz, the probes would be between 1 and 2 cm in diameter, and extend 0.5 to 1.0 cm into each magnetron cavity. The thickness of the photoconducting coating should be between 10 and 100 microns.

The probe 60 can be illuminated directly, using a single laser of moderate power or through optical fibers by either a single laser or an array of solid-state light sources, either light-emitting diodes or semiconductor lasers. In the event that multiple sources are used, each light source is coupled to a single optical fiber, which delivers the light it carries to the optical tuning element.

Figure 3B:
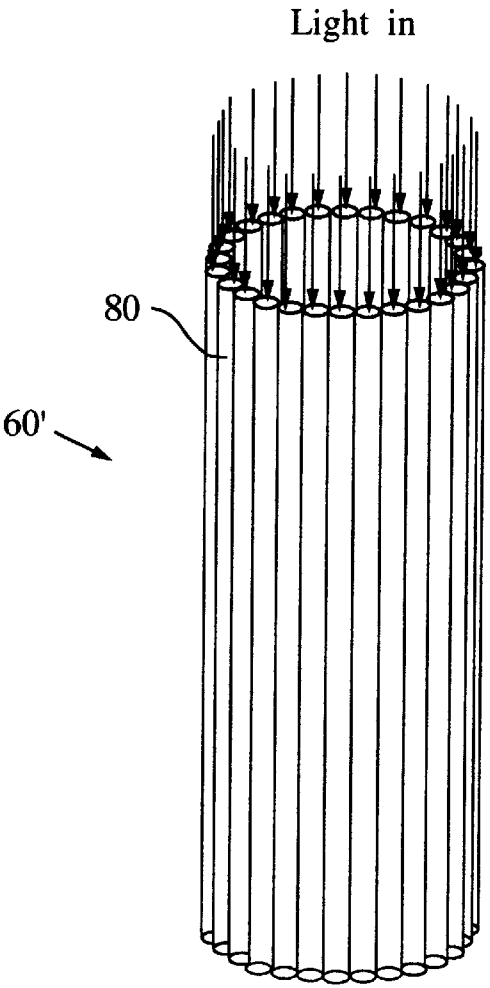
FIG. 3B is an illustration of a second embodiment of an optical tuning probe element.
Figure 3A:
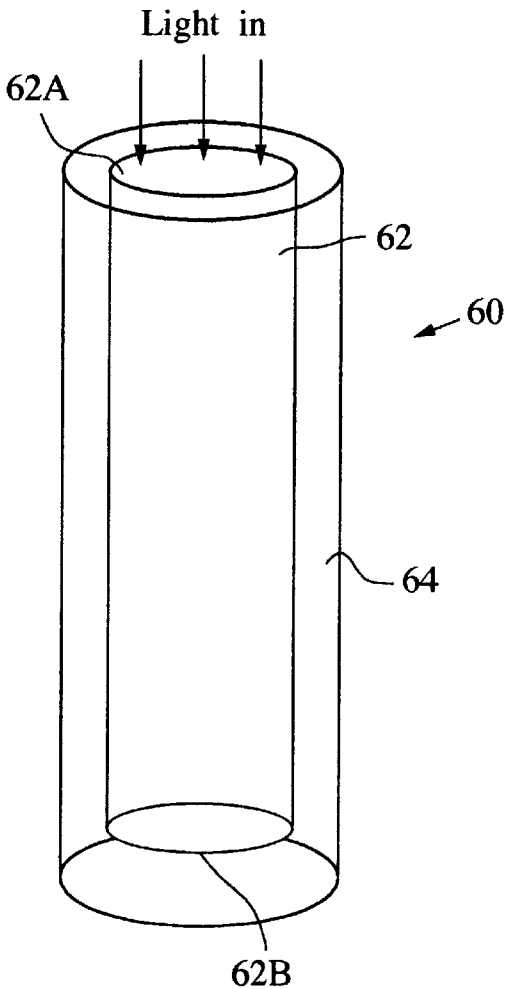
FIG. 3A is a diagrammatic illustration of a first embodiment of an optical tuning probe element employed in the magnetron structure of FIG. 1.

An alternate form of probe 60' is illustrated in FIG. 3B. This probe is constructed of a multitude of optical fibers 80, arranged around the periphery or envelope of the probe, e.g. around the cylinder surface. For the probe length, the cladding of the optical fibers has been stripped, and a photoconducting coating is applied to the outer surface of the length of each fiber. Light is delivered to the probe 60' by optical fibers, fed by either a single laser or by an array of solid-state light sources, as described above. If a single laser is used in conjunction with an optical feed network to feed either type of probe, optical power divider elements are provided to divide the output power evenly among the individual fibers.

As seen in FIG. 2, each resonant cavity 56 in the anode block 52 of the optically-tunable magnetron will be occupied by an optical tuning probe 60 like that shown in FIG. 3A or FIG. 3B. When no light is injected into the optical probes, the jackets do not strongly reflect the light leaking from the dielectric, and the probes dielectrically load the cavities, changing their resonant frequencies from their unloaded values. This loading is taken into account when the cavities are designed. If light is injected into each of the probes with equal intensity, then the resonant frequencies of each of the cavities can be changed by an equal amount, with the magnitude of the change depending on the light intensity. At full light intensity, the photoconductive coating acts like a conductor, and the magnetron behaves as though each of its cavities were occupied by a conductive probe.

While the probe embodiments illustrated in FIGS. 3A and 3B have cylindrical configurations, other configurations may be employed, e.g. configurations which conform to the shape of the cavities.

FIG. 4 is a simplified schematic diagram illustrative of the optical tuning control system for the magnetron oscillator 50 having the above described anode block and optical probes. The control system includes a light source 70 for producing light of the requisite wavelength to excite the photoconducting material, a light guide 72 between the light source and the probes 60 to guide the light into the dielectric probes, and a light source controller/intensity modulator 74. The controller/intensity modulator acts in response to tuning commands received externally, e.g., from a system controller for the system in which the magnetron is installed, to modulate the intensity of light injected into the probes. The intensity of the light is most easily modulated by directly modulating the light sources themselves. If a single moderate-power laser is used, the pumping power (used to create a population inversion) can be modulated. If an array of low-power solid-state light sources are used, the light intensity can be modulated by modulating the current that drives the individual light sources. This method has been used to modulate semiconductor lasers at microwave frequencies in the 10 GHz range and beyond. The light intensity can also be modulated using a Mach-Zehnder interferometer. This is a device that splits a light beam in two, shifts the phase of one beam by an amount determined by the applied voltage, and recombines the two beams, resulting in a reduced intensity if the phase difference between the two beams is not zero or a multiple of 2 pi. However, if each fiber is fed by its own optical source, it will also require its own Mach-Zehnder interferometer to modulate the light intensity, which is an expensive solution.

In a simple implementation, the modulator could take the form of a power on/off switch for the light source, so that two magnetron frequencies are provided, one for the case when the light source is off, the other for the case when the light source is on.

The diameter of the optical fibers that feed the optical probes is small compared to the wavelength of the RF radiation produced by the magnetron. FIG. 5 shows a fiber feedthrough plate 90 that holds each fiber 72, and is used to pass the optical fibers through the magnetron structure to conduct light from the light source system to the probes. The feedthrough plate 90 is constructed of a conductive material such as copper. A system of holes 82 is formed in the plate, separating each fiber with an electrical conductor. While each hole through which a fiber passes can allow RF to escape, this can occur only if the wavelength is comparable to the diameter of the hole. If the wavelength is shorter, the hole acts like a cutoff waveguide; if the hole is long (deep) enough, virtually no RF energy can escape. As an added measure, the fiber bundle leading into the magnetron can be wrapped in RF absorbing material and housed in a metal jacket (wire mesh can be used for flexibility); the RF energy is confined to the interior of the metal jacket, where it is absorbed by the RF absorbing material.

Figure 1:
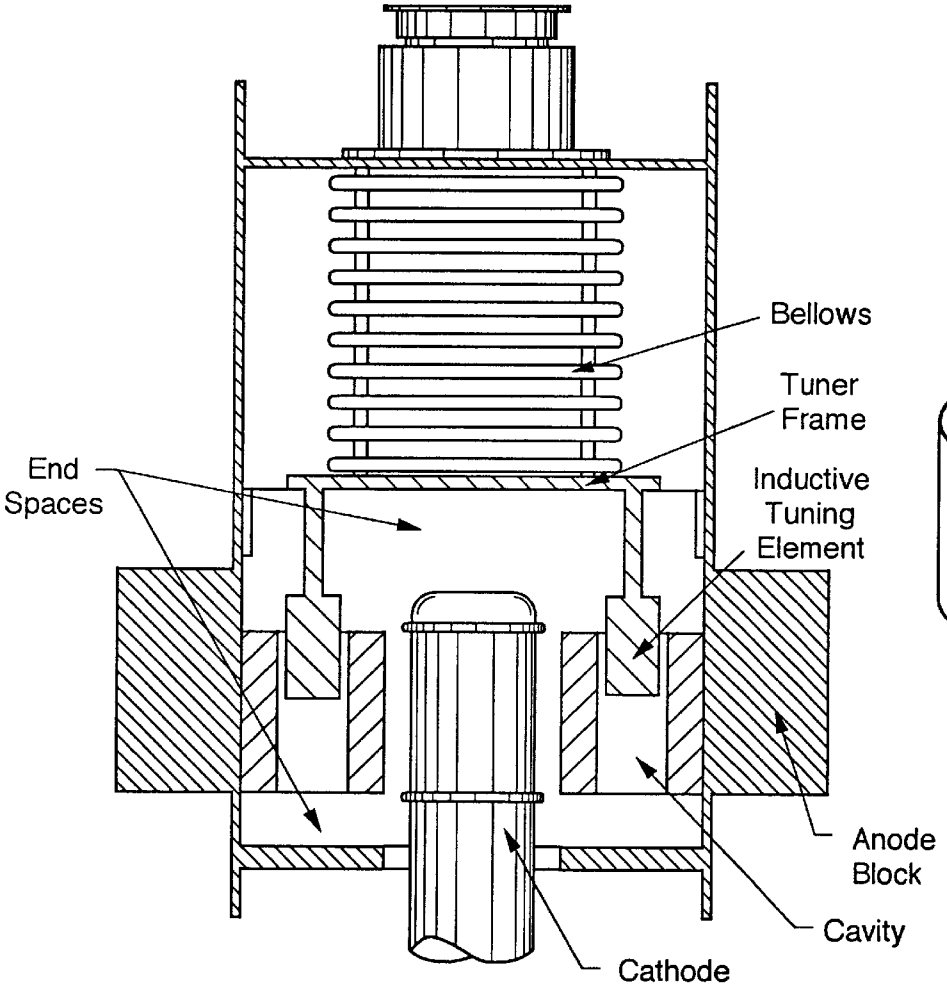
FIG. 1 ( PRIOR ART )
FIG. 1 is a cross-sectional view of a conventional plunger-tuned magnetron oscillator.

In contrast to the mechanical "Crown of Thorns" tuning mechanism illustrated in FIG. 1, which works by mechanically inserting and retracting metallic probes from each of the magnetron's resonant cavities, the optical tuning system of the present invention has the advantage that it involves no moving parts, so that tuning can be accomplished very quickly.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A magnetron having a microwave frequency range of operation, comprising:

an anode block;

a resonant cavity defined within the anode block;

apparatus for optically tuning a magnetron operating frequency within said range of operation, comprising a probe structure extending into said resonant cavity, said probe structure comprising a leaky dielectric light guide structure to which a photoconductive coating structure has been applied, a light source for directing light into the probe structure, apparatus for modulating the intensity of the light directed into the probe, wherein light propagating through the dielectric light guide structure leaks into the photoconductive coating structure, and is absorbed by the coating structure through creation of electron-hole pairs, causing the coating structure to reflect incident microwave radiation, the degree of reflection dependent on the incident light intensity, wherein the resonant frequency of the resonant cavity and the frequency of operation of the magnetron is tunable by modulating the intensity of the light directed into the probe structure and thereby changing in reflectivity of the coating structure, wherein said leaky dielectric light structure comprises a plurality of optical fibers, each fiber comprising a dielectric fiber with no cladding formed on the exterior surface of the dielectric fiber along a probe length portion, and said photoconductive coating structure comprises a photoconductive coating applied to the outer surface of each said dielectric fiber along said probe length portion.

2. The magnetron of claim 1 wherein said light source comprises a solid state light source.

3. The magnetron of claim 1 wherein said photoconductive coating is formed by single-crystal silicon.

4. The magnetron of claim 1 wherein said photoconductive coating is formed by germanium.

5. The magnetron of claim 1 wherein said light source comprises a laser for generating said light.

6. The magnetron of claim 1 wherein said plurality of optical fibers are arranged along the periphery of a cylindrical envelope.

7. The magnetron of claim 1 wherein said probe structure is fixed in position relative to said cavity.

8. A magnetron having a tunable microwave frequency range of operation, comprising:

an anode block having an interior space defined therein;

a plurality of resonant cavities defined within the anode block;

apparatus for optically tuning a magnetron operating frequency within said range of operation, the apparatus comprising:

a plurality of probes, wherein respective ones of said probes extends into corresponding ones of said resonant cavities, each of said probes comprising a respective leaky dielectric light guide to which a corresponding photoconductive coating has been applied;

a light source system for directing light into the respective probes; and apparatus for modulating the intensity of the light directed into the respective probes, wherein light propagating through the respective dielectric light guide leaks into the corresponding photoconductive coating, and is absorbed by the corresponding coating through creation of electron-hole pairs, causing the corresponding coating to reflect incident microwave radiation, the degree of reflection dependent on the incident light intensity, wherein the resonant frequency of the resonant cavity and the frequency of operation of the magnetron is tunable by modulating the intensity of the light directed into the respective probe and thereby changing in reflectivity of the corresponding coating.

9. The magnetron of claim 8 further comprising a cathode disposed within said anode block, and wherein said plurality of cavities are arranged radially about said cathode.

10. A magnetron having a tunable microwave frequency range of operation, comprising:

an anode block having an interior space defmed therein;

a cathode disposed within said interior space of said anode block;

a plurality of resonant cavities defmed within the anode block and arranged about said cathode;

apparatus for optically tuning a magnetron operating frequency within said range of operation, the apparatus comprising:

a plurality of probes, wherein respective ones of said probes extends into corresponding ones of said resonant cavities, each of said probes comprising a respective leaky dielectric light guide to which a corresponding photoconductive coating has been applied;

a light source system for directing light into the respective probes; and apparatus for modulating the intensity of the light directed into the respective probes, wherein light propagating through the respective dielectric light guide leaks into the corresponding photoconductive coating, and is absorbed by the corresponding coating through creation of electron-hole pairs, causing the corresponding coating to reflect incident microwave radiation, the degree of reflection dependent on the incident light intensity, wherein the resonant frequency of the resonant cavity and the frequency of operation of the magnetron is tunable by modulating the intensity of the light directed into the respective probe and thereby changing in reflectivity of the corresponding coating.

11. The magnetron of claim 10 wherein said light source system comprises a solid state light source.

12. The magnetron of claim 10 wherein said light source system comprises a laser for generating said light.

13. The magnetron of claim 10 wherein each of the probes is a structure comprising a respective dielectric, non-photoconducting rod and a corresponding outer jacket of said photoconducting material.

14. The magnetron of claim 10 wherein said corresponding photoconducting material is single-crystal silicon.

15. The magnetron of claim 10 wherein said corresponding photoconducting material is germanium.

16. The magnetron of claim 10 wherein each of said plurality of probes comprises a plurality of optical fibers each comprising a dielectric fiber with no cladding formed on the exterior surface of the dielectric fiber along a probe length portion, and a photoconductive coating applied to the outer surface of each said dielectric fiber along said probe length portion.

17. The magnetron of claim 16 wherein said plurality of optical fibers are arranged along the periphery of a cylindrical envelope.

18. The magnetron of claim 10 wherein said respective probes are fixed in position relative to said cavities.

19. The magnetron of claim 10 wherein said light source system includes a plurality of optical fibers for conducting light from a light source to each of said probes, and a feedthrough plate having a hole pattern for receiving therethrough corresponding ones of said optical fibers, the plate comprising an electrically conductive material for preventing microwave energy from escaping from the magnetron while passing said optical fibers from said light source to said respective probes.

* * * * *